US007771549B1

(12) United States Patent
Christe et al.

(10) Patent No.: US 7,771,549 B1
(45) Date of Patent: Aug. 10, 2010

(54) ENERGETIC IONIC LIQUIDS

(75) Inventors: Karl O. Christe, Calabasas, CA (US); Greg W. Drake, Palmdale, CA (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 815 days.

(21) Appl. No.: 10/681,502

(22) Filed: Oct. 7, 2003

Related U.S. Application Data

(60) Provisional application No. 60/416,418, filed on Oct. 7, 2002.

(51) Int. Cl.
*C06B 47/00* (2006.01)
*D03D 23/00* (2006.01)

(52) U.S. Cl. ..... 149/1; 149/109.4

(58) Field of Classification Search ..... 149/1, 149/92, 105, 109.4; 95/51; 502/190
See application file for complete search history.

(56) References Cited

U.S. PATENT DOCUMENTS 4,141,910 A * 2/1979 Flanagan et al. ..... 552/11
6,001,197 A * 12/1999 Wagaman ..... 149/45
6,048,388 A * 4/2000 Schwarz ..... 106/31.27
6,579,343 B2 * 6/2003 Brennecke et al. ..... 95/51
2005/0269001 A1 * 12/2005 Liotta et al. ..... 149/1

OTHER PUBLICATIONS

Anonymous. 2001. 2002 calendar year. at www.copleys.com.*
Design of Energetic Ionic Liquids, Boetz et al.*

* cited by examiner

*Primary Examiner*—Aileen Felton
(74) *Attorney, Agent, or Firm*—AFMCLO/JAZ; Thomas C. Stover

(57) ABSTRACT

Provided are energetic materials of low vapor pressure in the form of ionic liquids having fuel and oxidizer ions including, substituted pyridinium or imidazolium cations paired with nitrato-, perchlorato-, or nitramido-based anions, to form such ionic liquids or salts. The salts of the present invention are low melting and have essentially little or no vapor pressure over a wide temperature range. The salts of this invention are thus an important breakthrough since they can serve as high-performing monopropellants which are not complex mixtures and have no vapor toxicity. Such salts also find use as munitions, liquid explosives, reaction media for the synthesis of other high-energy materials, and as plasticizers.

18 Claims, No Drawings

ENERGETIC IONIC LIQUIDS

RELATED PATENT APPLICATIONS

This application claims the benefit under 35 U.S.C. 119(e) of U.S. provisional application No. 60/416,418, filed 7 Oct. 2002, in the USPTO.

STATEMENT OF GOVERNMENT INTEREST

The invention described herein may be manufactured and used by or for the Government for governmental purposes without the payment of any royalty thereon.

FIELD OF THE INVENTION

This invention relates to energetic materials, particularly in the form of ionic liquids.

BACKGROUND OF THE INVENTION

Ionic liquids are materials which melt at low temperatures, i.e. at or below ambient working conditions but are ionic salts. Recently they have received much attention for applications in green chemistry, replacing commonly used organic solvents in many kinds of reactions or in bi-phase catalysis. Whereas all of the previously known ionic liquids have been non-energetic materials, the materials of this invention have strongly oxidizing anions which are paired with either the well known alkyl substituted imidazolium or pyridinium cations or more energetic cations carrying either energetic or oxidizing substituents, such as azido- or nitro- groups. These cations serve as the fuel, resulting in highly energetic materials having applications in propulsion and explosive technologies.

One of the major hurdles to overcome in designing and making new propellants is creating an oxygen balance of fuel to oxidizer in one system. There is a large array of materials that are fuels, but relatively very few materials carry excess amounts of oxygen atoms to support the combustion of added fuels. Prior workers in the field have been investigating mixtures of oxygen rich salts of hydroxylammonium nitrate (HAN) with a wide array of fuel compounds as monopropellant materials.

Examples of related patents are U.S. Pat. No. 5,223,057 to Boggs et al. (1991), U.S. Pat. No. 6,001,197 to Wagaman (1999) and U.S. Pat. No. 6,331, 220 to Wagaman (2001). In spite of all these new materials, none of them offer the advantages of the compounds of the present invention, i.e., homogenous, highly energetic, single-phase systems exhibiting no vapor pressure over a very wide temperature range, thereby avoiding vapor toxicity and handling problems. Many of the previously described, highly reactive materials such as amine-, hydroxylammonium-, hydrazine-, or azido-based compounds, can be difficult to handle and/or be highly toxic and/or explosive. All of these materials are formulations, i.e. are mixtures with other energetic materials which often requires the use of stabilizers, solvents and chelating agents to make the formulations reasonably stable/usable. This is highly undesirable from a practical point of view, as mixtures can degrade, separate, or precipitate ingredients over time or during thermal cycling.

Thus, there is a need and market for energetic materials that overcome the above shortcomings.

There have now been developed novel energetic materials of low vapor pressure and reduced toxicity as described below.

SUMMARY OF THE INVENTION

Broadly the present invention provides energetic materials of low vapor pressure which include ionic liquids having fuel cations and oxidizer anions.

The invention further provides energetic materials of low vapor pressure including ionic liquids having substituted imidazolium or pyridinium cations that are paired with nitrato- or perchlorato-based anions.

Typically for the well known class of ionic liquids, cations are either substituted imidazolium rings or 1-N-alkyl-substituted pyridinium rings, paired with well known anions including simple halides, tetrahaloaluminate ($AlX_4^-$), nitrate, or hexafluorophospate. However, in the case of materials to be used for energetic purposes one must achieve an oxygen balance for reasonable performance values. The typical energetic anions used in the propellant community such as nitrate, perchlorate, dinitramide, and nitroformate, do not carry enough oxygen atoms for combustion of the large organic based cations typically used in ionic liquids.

As described below, the invention discloses a large family of new ionic liquids offering an excellent alternative to many well known energetic materials. Ionic liquids using large bulky asymmetric organic cations are used for a wide array of applications, but no applications have been cited for their use in energetic materials. Herein, a description of the application of ionic liquids to energetic systems, such as monopropellants, liquid oxidizers, explosives, or plasticizers will be brought to light. As one possible example, these new ionic liquids can offer an excellent alternative in the field of monopropellants where the current state of the art is hydrazine, a highly toxic, carcinogenic, and a relatively poorly performing rocket propellant. These new ionic liquids are oxygen balanced with respect to self-combustion and have wide liquid ranges and negligible vapor pressures.

This new class of energetic materials is based upon low melting salts of cations derived from alkyl substituted heterocyclic quaternary ammonium cations, such as 1,3-disubstituted imidazolium or N-alkyl substituted pyridinium cations, and high-oxygen-content anions. These new liquid salts offer many advantages over previously known propellants such as hydrazine, including significantly lowered vapor toxicity due to negligible vapor pressure, much lower melting points (well below 298 K), higher densities and improved specific impulse performance. These new materials are also excellent alternatives to the well known but problematic systems based on low melting energetic oxygen carrier salts such as hydroxylammonium nitrate (HAN) or hydroxylammonium perchlorate (HAP), which must be formulated with various fuels, resulting in mixtures that exhibit many drawbacks, such as significant vapor pressures of one or several components, potential demixing or phase separations upon cooling, or evaporation of the most volatile component and decreased performance due to the use of significant amounts of low or non-energetic solvents required to keep all components in solution. These drawbacks often result in highly reactive and sensitive/explosive mixtures. The present invention overcomes these problems. It includes a single, highly energetic component that exhibits no vapor pressure over a very wide liquid range.

The new invention utilizes the novel concept of using ionic liquids as energetic materials in monopropellants, liquid gun propellants and new explosive scenarios. These novel ionic liquids have significant advantages over the current state of the art, hydrazine. Hydrazine has a high vapor toxicity and relatively low performance. These drawbacks are overcome by the compounds of this invention. No one had previously considered the idea of using the class of materials identified as ionic liquids as true monopropellants. What is meant by a true monopropellant is a material which is made of one compound only, and needs not be formulated or mixed with other materials to be oxygen balanced to achieve the usual combustion stoichiometry, i.e., carbon being combusted to carbon monoxide or carbon dioxide and hydrogen oxidized to water, which is required in propellant combustion for maximum specific impulse. Furthermore, ionic liquids have no vapor pressure at ambient temperature, thus avoiding the vapor toxicity problem associated with the use of hydrazine.

The key elements of the present invention are either the use of large complex anions that can carry sufficient oxidants to achieve complete or near complete combustion of the large organic cations or the reduction of the oxygen-carrying requirement for the anion and increase of the energetics of the ionic liquid propellants by modifications of the cations involving the introduction of energetic groups, such as nitro- or azido-groups, into the alkyl side chains for complete or near complete combustion of such cations The ionic liquids of this invention, which are based on modifications of the cations, result from the incorporation of energetic groups, such as nitro- or azido- groups, into the alkyl side chains. This approach permits the use of simple, well known, and readily available oxidizing anions, such as perchlorate, nitrate, dinitramide, or nitroformate to achieve the critical $H_2O/CO/CO_2$ balances and good performance. Typical examples for energetic-group-containing side chains are —$CH_2$—$N_3$ (azidomethyl), —$CH_2$—$CH_2$—$N_3$ (azidoethyl), —$CH_2$—$NO_2$ (nitromethyl), —$CH_2$—$CH_2$—$NO_2$ (nitroethyl), —$CH(NO_2)_2$ (dinitromethyl), —$CH_2$—$CH(NO_2)_2$ (gem-dinitroethyl), and —$CH_2$—$C(NO_2)_3$ (gem-trinitroethyl). The following examples demonstrate how the critical $H_2O/CO/CO_2$ balances can be achieved with simple oxidizer anions, but are not intended to limit the scope of the present invention.

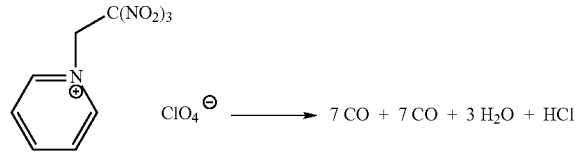

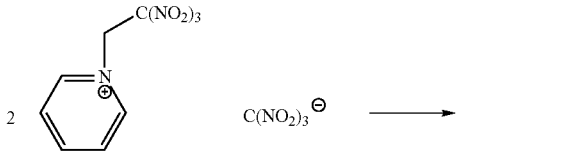

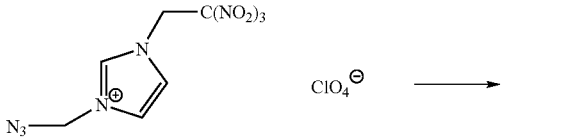

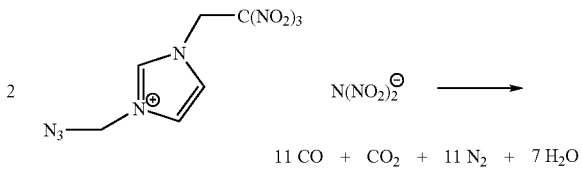

-continued

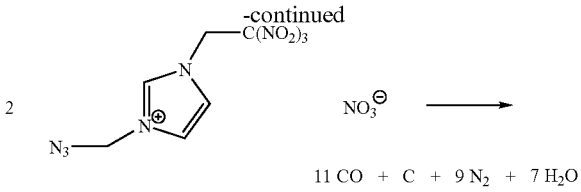

The second approach of our new concept utilizes the well known cations, such as 1-ethyl-3-methylimidazolium, 1-n-butyl-3-methylimidazolium, and N-n-butylpyridinium, which are commonly used in ionic liquid applications. These cations are paired with a large class of well known anions which carry enough oxygen to achieve a $H_2O/CO/CO_2$ balance during self-combustion. These species are complex nitrato- and perchlorato-based anions, which have been well characterized for several decades by different industrial and academic research groups. These anions include the tetranitratoborate $[B(O—NO_2)_4]^-$, tetranitratoaluminate $[Al(O—NO_2)_4]^-$, pentanitratoaluminate $[Al(O—NO_2)_5]^{2-}$, hexanitratoaluminate $[Al(O—NO_2)_6]^{3-}$, hexanitratophosphate $[P(O—NO_2)_6]^-$, tetraperchloratoborate $[B(O—ClO_3)_4]^-$, tetraperchloratoaluminate $[Al(O—ClO_3)_4]^-$, pentaperchloratoaluminate $[Al(O—ClO_3)_5]^{2-}$, hexaperchloratoaluminate $[Al(O—ClO_3)_6]^{3-}$, and hexaperchloratophosphate $[P(O—ClO_3)_6]^-$ anions. These ionic liquids can be prepared in simple, one-step, high-yield processes from easily obtainable reagents by those skilled in the art.

The following systems demonstrate the ability of the new invention to achieve the critical $H_2O/CO/CO_2$ balances, and hence, good performances in energetic scenarios.

$$2[C_6H_{11}N_2^+][B(ONO_2)_4^-] \rightarrow 10\ CO + 2\ C + 11\ H_2O + B_2O_3 + 4\ N_2$$

$$2[C_6H_{11}N_2^+][P(ONO_2)_6^-] \rightarrow 4\ CO + 8\ CO_2 + 11\ H_2O + P_2O_5 + 8\ N_2$$

$$2[C_8H_{15}N_2^+][B(OClO_3)_4^-] \rightarrow 14\ CO + 2\ CO_2 + 11\ H_2O + 8\ HCl + B_2O_3 + 2\ N_2$$

$$2[C_9H_{14}N^+][Al(OClO_3)_4^-] \rightarrow 17\ CO + CO_2 + 10\ H_2O + 8\ HCl + Al_2O_3 + N_2$$

$$2[C_6H_{11}N_2^+][Ti(ONO_2)_5^-] \rightarrow 9\ CO + 3\ CO_2 + 11\ H_2O + 2\ TiO_2 + 7\ N_2$$

In these systems, the syntheses of the desired ionic liquids can be carried out in a facile manner through the use of the appropriate organic cation chloride salt combined with a stoichiometric amount of the halo-derivative of the desired anion through the use of either dinitrogen tetroxide for the formation of complex nitrates or the use chlorine perchlorate for the formation of complex perchlorates. The routes are essentially quantitative and single-step, and the desired ionic liquid products are easily separated from the volatile reaction products, resulting in high purity products ready for use.

As an example of this new invention, the synthesis of 1-ethyl-3-methylimidazolium tetranitratoborate $[C_6H_{11}N_2][B(ONO_2)_4]$ is carried out in one step through the reaction of 1-ethyl-3-methylimidazolium chloride, boron trichloride, and excess nitrogen tetroxide.

$$BCl_3 + [C_6H_{11}N_2^+][Cl^-] + xs\ N_2O_4 \rightarrow [C_6H_{11}N_2^+][B(ONO_2)_4^-] + 4\ NOCl$$

The products of the reaction are easily separated, because nitrosyl chloride is highly volatile and easily removed from the desired reaction product which, as an ionic liquid, has essentially no vapor pressure.

The following example is intended to illustrate the invention and should not be construed in limitation thereof.

Example 1

1-ethyl-3-methylimidazolium tetranitratoborate $[C_6H_{11}N_2^+][B(ONO_2)_4^-]$: To a 0.75 inch Teflon FEP U-tube equipped with a Teflon stir bar and closed by a stainless steel valve, 0.6389 g, 5.75 mmoles of 1-ethyl-3-methylimidazolium chloride was added. The reaction U-tube was attached to a stainless steel manifold, evacuated and then chilled to −196° C. Boron trichloride, $BCl_3$, 5.76 mmoles was condensed into the U-tube, followed by nitrogen tetroxide, $N_2O_4$, 58 mmoles. The U-tube was then sealed off and transferred to a −31 C. slush bath for one hour, followed by transfer to a −12 C. slush bath for one additional hour. At the end of this time, the volatiles were removed from the reaction mixture over a period of 2 hours at −12° C. The U-tube contents were then allowed to warm to ambient temperature overnight in a dynamic vacuum leaving behind a yellow liquid. The yellow liquid was dissolved in anhydrous ammonia and filtered into another Teflon U-tube. Subsequent evacuation to a constant weight over 24 hours resulted in a light yellow, free-flowing liquid of 1-ethyl-3-methylimidazolium tetranitratoborate, 4.3 mmoles. Melting point: (−25° C.).

These new energetic ionic liquids have a wide array of possible applications ranging from monopropellants, explosives and munitions to plasticizers. By being pure compounds, and not mixtures of several compounds, as in the prior art, uniform physical properties and performance are guaranteed. The prior art uses formulations, i.e., mixtures with other energetic materials, which often requires the use of stabilizers, solvents, and chelating agents to make the said formulations reasonably stable/usable. This is highly undesirable from a practical point of view, as these mixtures contain volatile components exhibiting significant vapor pressure. Furthermore, as noted above, these mixtures can degrade, separate, or precipitate ingredients over time or during thermal cycling. This new invention avoids this and represents a breakthrough in the field of ionic liquids and energetic materials. These ionic liquids can have many applications in both propellants and explosives.

Accordingly, these new salts have applications as new monopropellant materials, as liquid media for other energetic materials to make high energy and high density liquid propellant materials, for rockets and missiles, gun propellants, ammunition materials, and as liquid explosives. These salts will also have applications as new reaction media for the synthesis of other high energy materials, most notably in the case of oxidation reactions, and for synthesizing azo, nitro, nitrato, azoxy, and nitroazoxy compounds. They also can find use as extraction and reaction media for handling and synthesizing other highly energetic materials and replacing volatile and corrosive reagents and solvents such as halocarbons or mixed acid systems used in nitration reactions.

What is claimed is:

1. Energetic material of low vapor pressure comprising, ionic liquids having fuel cations and oxidizer anions, wherein wherein said anions carry sufficient oxidants to achieve complete or near complete combustion of said cations.

2. The material of claim 1 wherein said ionic liquid has cations and anions that define a single type of ionic compound or a plurality of types of ionic compounds.

3. The material of claim 1 wherein said cations are asymmetric.

4. The energetic material of claim 1 wherein said ionic liquids are selected from the group consisting of N-alkyl substituted pyridinium or N-alkyl substituted imidazolium cations paired with nitrate, perchlorato, or nitramido based anions.

5. The energetic material of claim 4 wherein said N-alkyl substituents contain energetic groups comprising, azido- or nitro- groups.

6. The energetic material of claim 4 wherein said cation is the 1-N-(2,2-dinitroethyl), 3-N-azidomethyl, 1,3-imidazolium cation.

7. The energetic material of claim 4 wherein said cation is the 1-N-(2-trinitroethyl), 3-N-azidomethyl, 1,3-imidazolium cation and said anion is $ClO_4^-$, $N(NO_2)_2^-$, $NO_3^-$, or $C(NO_2)_3^-$.

8. The energetic material of claim 4 wherein said cation is the 1-N-(2-trinitroethyl), pyridinium cation and said anion is $ClO_4^-$, $N(NO_2)_2^-$, or $C(NO_2)_3^-$.

9. The energetic material of claim 4 wherein said cations are $C_8H_{10}N_2$, $C_9H_{14}N$ or $C_6H_{11}N_2$.

10. The energetic material of claim 4 wherein said anions and cations carry sufficient oxygen to achieve an $H_2O/CO/CO_2$ balance during self-combustion.

11. The energetic material of claim 4 wherein said anions are selected from the group consisting of $ClO_4^-$, $NO_3^-$, $N(NO_2)_2^-$, $C(NO_2)_3^-$, $B(ONO_2)_4^-$, $Al(ONO_2)_4^-$, $Al(ONO_2)_5^{-2}$, $Al(ONO_2)_6^{-3}$, $P(ONO_2)_6^-$, $Ti(ONO_2)_5^-$, $Ti(ONO_2)_6^{-2}$, $B(OClO_3)_4^-$, $Al(OClO_3)_4^-$, $Al(OClO_3)_6^{-2}$, $Al(OClO_3)_6^{-3}$, $Ti(OClO_3)_5$, $Ti(OClO_3)_6^{-2}$, and $P(OClO_3)_6^-$.

12. The energetic material of claim 4 comprising pairing a cation of 1-N,3-N-dialkylsubstituted imidazolium rings or 1-N-alkylsubstituted pyridinium rings with an anion of claim 9 to form an ionic liquid.

13. The energetic materials of claim 9 wherein said ionic liquids are selected from the group consisting of $[C_6H_{11}N_2^+][B(ONO_2)_4^-]$, $[C_6H_{11}N_2^+][P(ONO_2)_6^-]$, $[C_8H_{16}N_2^+][B(OClO_3)_4^-]$, $[C_9H_{14}N^+][Al(OClO_3)_4^-]$ and $[C_6H_{11}N_2^+][Ti(ONO_2)_5]$.

14. A method of preparing an energetic ionic liquid comprising reacting:

$$BCl_3+[C_6H_{11}N_2^+][Cl^-]+xs\ N_2O_4 \rightarrow [C_6H_{11}N_2^+][B(ONO_2)_4^-]+4NOCl.$$

15. The ionic liquids of claim 1 employed in monopropellants, explosives, munitions or plasticizers.

16. The ionic liquids of claim 1 employed in oxidation reactions and for synthesizing azo, nitro, nitrato, azoxy and nitroazoxy compounds.

17. The energetic material of claim 6 wherein said anion is $ClO_4^-$.

18. The energetic material of claim 6 wherein said anion is $N(NO_2)_2$.

* * * * *